US005890929A

United States Patent [19]

Mills et al.

[11] Patent Number: 5,890,929

[45] Date of Patent: Apr. 6, 1999

[54] SHIELDED MEDICAL CONNECTOR

[75] Inventors: Michael A. Mills, Golden, Colo.; Robert A. Smith, Lake Forest, Calif.

[73] Assignee: Masimo Corporation, Mission Viego, Calif.

[21] Appl. No.: 868,164

[22] Filed: Jun. 3, 1997

Related U.S. Application Data

[60] Provisional application No. 60/020,018, Jun. 19, 1996 and provisional application No. 60/020,254, Jun. 24, 1996.

[51] Int. Cl. [6] ..... H01R 9/03

[52] U.S. Cl. ..... 439/610; 439/98; 439/939

[58] Field of Search ..... 439/95, 98, 99, 439/101, 108, 607, 609, 610, 931, 939, 339, 320, 323

[56] References Cited

U.S. PATENT DOCUMENTS

| | | | |
|---|---|---|---|
| 3,387,606 | 6/1968 | Crafts et al. . | |
| 3,534,310 | 10/1970 | Pelissier . | |
| 3,743,989 | 7/1973 | Nicolas et al. . | |
| 3,995,209 | 11/1976 | Weston . | |
| 4,038,625 | 7/1977 | Tompkins et al. . | |
| 4,684,245 | 8/1987 | Goldring . | |
| 4,690,492 | 9/1987 | Beard . | |
| 4,838,808 | 6/1989 | Fujiura . | |
| 4,961,711 | 10/1990 | Fujiura et al. . | |
| 5,380,213 | 1/1995 | Piorunneck et al. . | |
| 5,585,806 | 12/1996 | Ogino et al. | 439/610 X |
| 5,597,322 | 1/1997 | Inaba et al. | 439/528 |
| 5,658,170 | 8/1997 | Tan et al. | 439/610 |
| 5,683,270 | 11/1997 | Warislohner | 439/610 |

FOREIGN PATENT DOCUMENTS

WO 93/13573 7/1993 WIPO .

*Primary Examiner*—Khiem Nguyen
*Attorney, Agent, or Firm*—Knobbe, Martens, Olson & Bear, LLP

[57] ABSTRACT

An electrical connector for a medical instrument has a plug containing a plurality of pins in electrical communication with wires emanating from a shielded cable that is connected to a medical sensor detecting physiological data. The plug portion of the electrical connector substantially surrounds the connection of the pins with the cable in a plastic housing. When the plug is inserted in to a socket portion of the connector mounted to a medical instrument housing, the pins electrically communicate with a plurality of tubular sockets to communicate the signals to electronic devices in a medical instrument. Surface coatings on the connector are provided to shield the wire connections with the pins and tubular sockets from electromagnetic interference (EMI). A tubular shield is also provided in the medical instrument to shield the electrical connection between the internal cable and the tubular receptacles from EMI. The EMI shields on the connector and the EMI shielding on the connecting cables are all connected to a common ground. A significant reduction in EMI distortion of the sensor signals is achieved.

23 Claims, 5 Drawing Sheets

SHIELDED MEDICAL CONNECTOR

This Application is claim for benefit of Provisional application Ser. No. 60/020,018 filed Jun. 19, 1996 and a provisional of 60,020,254 filed Jun. 24, 1996

FIELD OF INVENTION

This invention relates to EMF shielded connectors for use with medical devices, and particularly to retrofit shielding for a widely used connector for medical devices such as an oximeter.

BACKGROUND OF INVENTION

In hospitals it is common to have sensors monitoring patients by sensing a variety of parameters. These sensors monitor, among other things, heart rate, breathing rate, and various blood gases, including the oxygen content in the blood. The medical instruments that analyze and display the data from these sensors are typically located some distance from the patient and the sensors. A variety of cables connect these sensors to the instruments and often transmit electrical signals containing the sensor data from the patient to the instruments. Because these sensors are connected to, or used near patients, very low electrical currents and voltages are preferably used in these sensors and cables. As a result, the signals from the sensors are subject to electromagnetic interference ("EMI") from a variety of sources, including room lights, electric wall outlets, and other electrical devices. Radio Frequency interference, or RF interference also presents a concern, but all types of interference will be referred to as EMI for convenience in this application.

One medical device subject to this EMI is a blood oximeter. The sensor cables connect to this oximeter through a cable that connects to an instrument casing containing the electronic analysis equipment. The cable connects to the instrument through a widely used plastic coupling or connector made by Hypertronics, with the connector comprising a plurality of male pins that are inserted into a corresponding socket connected to the oximeter instrument housing. A resilient lever hook holds the two parts together. To reduce EMI disruption of the signals, the sensor cable is shielded. Further, the instrument housing is also shielded, as is the cable inside the instrument. Similar shielding steps are used in the cables on other medical instruments where these cable connectors are used.

But despite the shielding in the instrument casing and cable, sensor signals from this oximeter are subject to interference from even the 60 Hz florescent lights commonly used in hospitals. There is thus a need for improved performance of medical devices in general, and from this oximeter in particular. Further, there is a need for a way to reduce or eliminate EMI disruption and distortion of the signals from these medical instruments in general, and for medical equipment using this particular Hypertronics connector in particular.

SUMMARY OF THE INVENTION

The Applicants have discovered that despite the extensive shielding in the cables and instrument housings, significant EMI distortion still occurs. The Applicants have identified a major source of this EMI distortion as a lack of shielding in a widely used connector on the end of the cable transmitting sensor information from the patient. The connections from the sensor cable to the pins comprising the plug portion of the connector, are unshielded. While the length of the unshielded portion of the external connector is small, it has been discovered that the length is sufficient for significant EMI distortion. Similarly, for this widely used plastic connector, the connection from the shielded cable internal to the instrument that connects the socket to the internal components is also unshielded. Even though the instrument housing is shielded, there appears to be sufficient EMI distortion from the electronic components inside the instrument that shielding the socket portion of the connector mounted to, and even inside the instrument, is also advantageous. Thus, there is provided an improved shielding for this particular Hypertronics connector configuration, including not only means for shielding the plug portion of the connector that is external to the medical instrument, but also shielding the socket portion mounted onto and inside the instrument. These various connector shielding components are advantageously connected to a common ground, as are the EMI shielding from the cables connected to the plug and socket.

DESCRIPTION OF THE ILLUSTRATED EMBODIMENT

Figure 1:
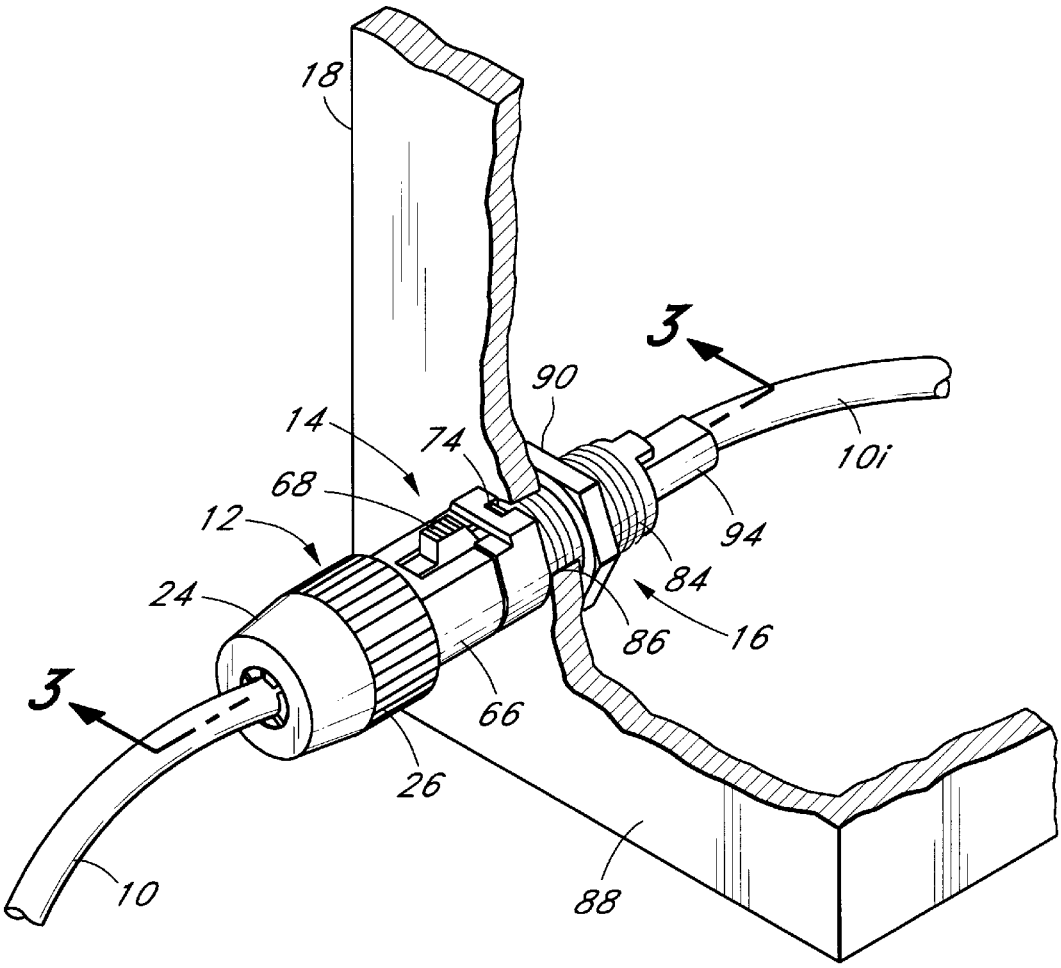
FIG. 1 shows a perspective view of a connector of this invention.

Referring to FIG. 1, a sensor cable 10 has a first end connected to a sensor that receives data from a patient (not shown) and transmits that data in the form of electrical signals to a second end of the cable 10 that terminates in a cable plug assembly 12 of connector 14. The cable plug 12 connects to a plastic socket 16 mounted to the instrument 18. The cable 10 is external to the instrument 18. The cable 10 contains a plurality of wires surrounded by EMI shielding, such as conductive sheath 19, typically comprising a sheath made of metal mesh, such as copper mesh. The sheath 19 shields the wires in cable 10 from EMI. The sheath 19 is grounded, as described later.

The various parts of the connector 14 will be described relative to the central axis of the sensor cable 10 and the instrument cable **10*i*. The letter "i" is added to several part numbers, such as cable 10*i*, to designate the parts in the socket 16 within the "i"nstrument that have corresponding parts in the cable plug 12. The direction along the axis of the cables 10, 10*i* toward the patient will be referred to herein as the distal direction. The direction along the cables 10, 10*i* toward the inside of the instrument 18 will be referred to as the proximal direction. Radial directions will be relative to the longitudinal axis of cables, 10, 10*i***.

Construction

Figure 2:
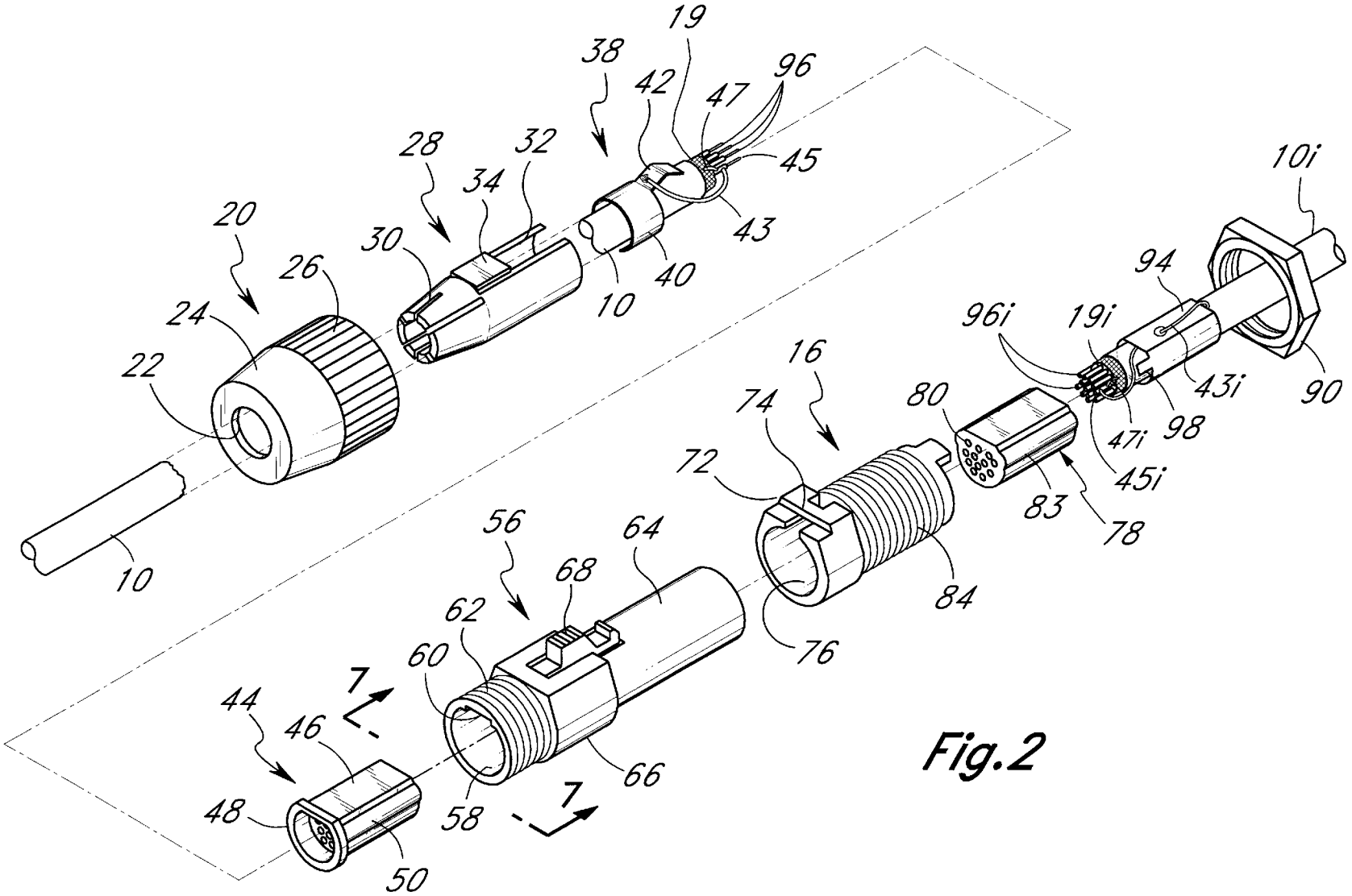
FIG. 2 shows an exploded assembly view of a connector of this invention.
Figure 3:
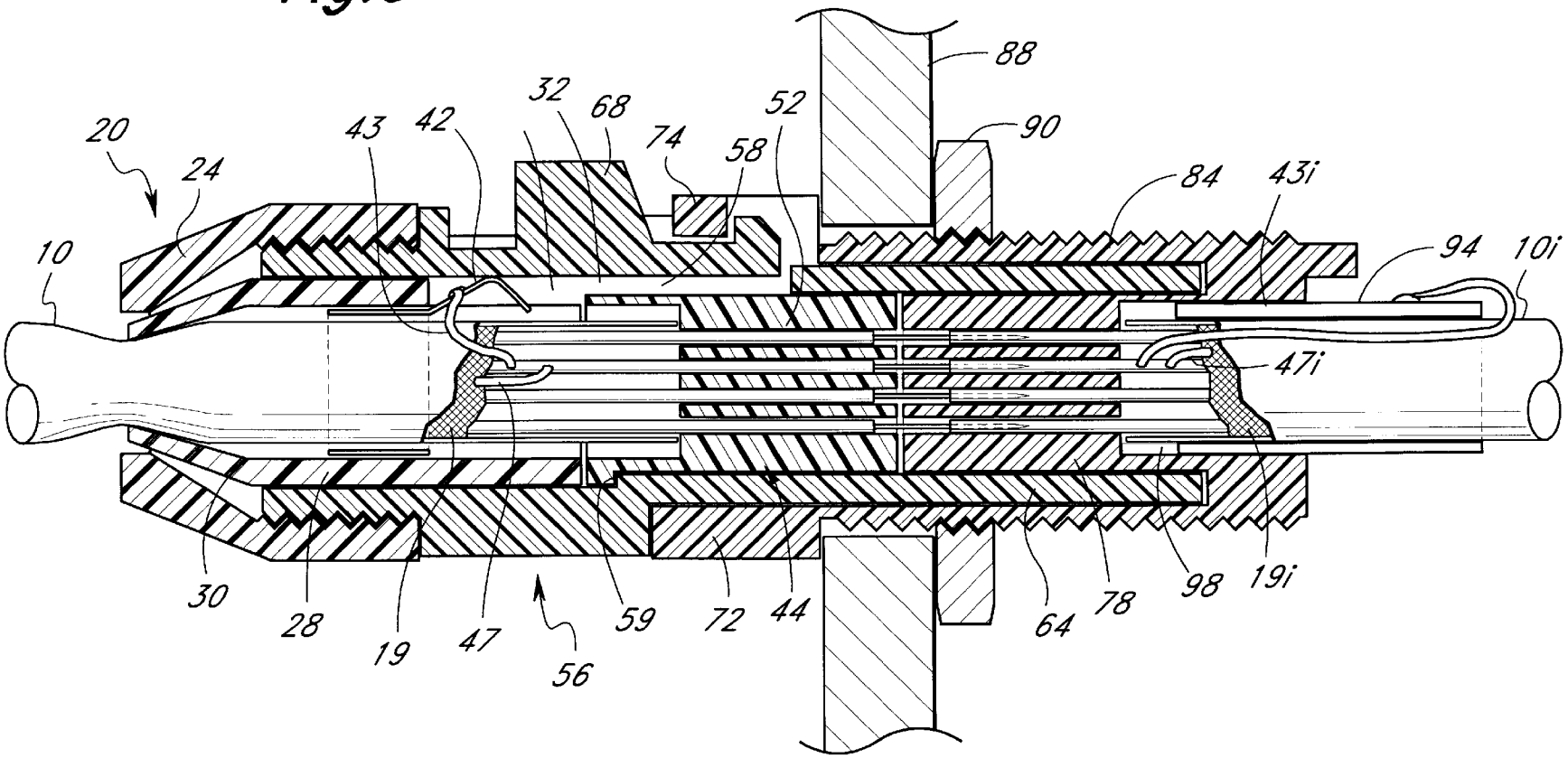
FIG. 3 shows a cross-sectional view taken along 3—3 in FIG. 1.

Referring to FIGS. 2 and 3, the male plug 12 comprises a plastic nut 20 having a tubular shape with a flange on its distal end that extends radially inward to form aperture 22 in the end of the nut 20 through which cable 10 can be inserted. The distal end 24 of the nut 20 is advantageously tapered inward toward cable 10. The proximal end of nut 20 has a textured surface 26, such as ribbing or knurling on its exterior surface to facilitate gripping and turning the nut 20 by hand. The proximal end of the nut 20 also has an engaging surface to hold the nut onto plug 56. Preferably this engaging surface comprises internal threads as best seen in the cross-section of FIG. 3.

An internal clamping tube 28 is made of plastic and sized and configured so that its distal end fits inside the nut 20. The clamping tube 28 has its distal end tapered inward toward the cable 10 to define an aperture through which cable 10 can extend. The distal end of the clamping tube 28 has a plurality of slots that form splines 30. The slots and splines extend along about ⅓ of the axial length of the tube 28. The proximal end of clamping tube 28 has a single slot 32 that extends about ⅓ the axial length of the tube 28. The slot 32 ends at a flat portion 34. The flat portion extends for about ⅓ the axial length of the tube 28, intermediate the slot 32 and splines 30.

An electrically conductive part, such as clip 38, is sized and configured so that its distal portion fits inside the tubular connector 28. The distal end 40 of clip 38 is advantageously semicircular, shaped like a wide hoop that conforms to the inside shape of tubular connector 28. Clip 38 is preferably made of thin, spring brass or other highly conductive metal. The distal end 40 has an axial length about the same as the axial length of flat piece 34. The proximal end of clip 38 comprises a flat piece bent to form spring tab 42. The tab 42 is sized to fit inside slot 32 but bent to extend radially outward so that it extends beyond the diameter of the clamping tube 28, and radially outward from the flat piece 34. Tab 42 is resiliently urged radially outward. A wire 43 electrically connects the clip 38 to ground.

Preferably wire 43 is electrically connected to pin 45 which is at ground potential. Pin 45 is one of the plurality of pins 96 and is connected to one of the wires in cable 10. Referring to FIGS. 2 and 3, the proximal end of the cable 10 terminates in a series of prongs or pins 96, preferably with each of the internal wires in sensor cable 10 terminating in its own pin. Preferably, the wire 43 is soldered to one of those pins, pin 45. Further, the conductive sheath 19 is also electrically connected to the same ground through pin 45. Advantageously, a wire 47 electrically connects the conductive sheath 19 to the pin 45. The wire 47 may be a separate wire 47 with opposing ends soldered to the pin 45 and sheath 19, respectively. Preferably, at least a portion of the conductive sheath 19 is twisted into a conductive, wire-like connector and soldered directly to pin 45.

A pin holder 44 is made of plastic and has an exterior shape of a cylinder with a flat top 46. A flange 48 conforms to the shape of, and extends radially outward from, the distal end of the pin holder 44. The cylindrical portion of flange 48 is about the same diameter as, and abuts the proximal end of, clamping tube 28. Along the exterior of cylindrical portion of pin holder 44 are three longitudinally extending ribs 50, with two ribs 50 adjacent the flat top 46, and the third rib 50 in between. The ribs 50 have a maximum radial distance corresponding to the outer diameter of the cylindrical portion of flange 48. Inside the pin holder 44 is a wall containing a plurality of tubes 52 that extend along the axial length of the pin holder 44. The tubes 52 are adapted to hold pins 96.

A releasable plug 56 made of plastic has an interior cavity divided into distal cavity 58 and proximal cavity 58', with the cavity 58, 58' extending the longitudinal length of plug 56. The distal cavity 58 has an semicircular interior shape with a flat top containing a slot 60 having a generally rectangular cross-section. The distal cavity 58 is sized and configured so that the pin holder 44 can be slidably received inside the cavity 58, with the flange 48 snugly fitting inside the distal cavity 58. The slot 60 is sized and configured so that the tab 42 and flat piece 34 fit within the slot 60 with the tab 42 rubbing the slot 60.

Intermediate the walls of cavity 58, 58' and the components contained in that cavity is a layer of conductive material. This conductive material could comprise a thin sheet of metal conforming to the shape of cavity 58, 58', but preferably the plastic walls of cavity 58, 58' and slot 60 are coated with a thin, electrically conductive material to form an electrically conductive surface on the cavity 58, 58'.

A copper-nickel layer formed by sputtering or vapor deposition is believed suitable to coat the plastic plug 56 with this electrically conductive layer. A conductivity of about 1–2 ohms per square inch is believed suitable. The conductive layer is thin enough that it can be added to pre-existing plugs 56 without hindering the assembly of the parts inside the cavity 58, 58'. Alternatively, a conductive paint, such as a polymer thick film conductive silver coating may be spray painted onto appropriate parts of the plug 56 with appropriate masking of those portions where a conductive coating is not desired. An E-2716, Bac-58, material may be used as such a silver coating. The durability of such a coating, however, is not sufficient to encourage its use on those parts or portions of parts that experience high wear rates, such as the slot 60 abutting tab 42. The thickness of the coating is selected to give the desired conductivity, with a conductivity of about 1–2 ohms per square inch believed suitable.

The distal end of plug 56 contains an engaging surface that cooperates with the engaging surface on nut 20 to hold the plug 56 and nut 20 together. Preferably the engaging surface on plug 56 comprises external threads 62 that are sized and configured to threadably engage the internal threads on nut 20. The proximal end 64 of plug 56 has a cylindrical exterior shape, and contains the interior proximal cavity 58' that connects to the distal cavity 58. The proximal end 64 has its interior proximal cavity 58' configured to snugly, but slidably accommodate the insertion of the top 46 and ribs 50 on the cylindrical portion of pin holder 44. Further, this shape of the proximal cavity 58' is also adapted to accommodate a socket holder 78 that is described later. The proximal cavity 58' has a slightly small cylindrical diameter than the distal cavity 58. Further, the proximal cavity 58' is slightly offset from distal cavity 58 with the offset forming a semi-circular ledge 59. The ledge 59 engages flange 48 to restrain axial movement of pin holder 44, as explained later.

Intermediate the threads 62 and proximal end 64 is a gripping portion 66 that has a larger diameter than that of either the threads 62 or proximal end 64. The gripping portion 66 contains a cantilevered latch 68 that extends from the portion 66 and toward the proximal end 64. The interior surface of lever 68 forms the portion of the top of cavity 58, 58' and is coated with the same electrically conductive metal as the cavity 58, 58', and is electrically connected to the distal cavity 58, and also proximal cavity 58'. A slight gap separates latch 68 from plug 56 so that the latch 68 can be recessed into the cavity defined by rectangular slot 60 and semicircular cavities 58, 58'. In more detail, the semicircular portion of cavity 58 and the rectangular slot 60 extend along the axial length of plug 56 to the beginning of the proximal end 64 and proximal cavity 58'. The latch 68 extends from the distal cavity 58 and slot 60 into the proximal cavity 58'. At the juncture of the distal cavity 58 and proximal cavity 58', the rectangular slot 60 ends, and the remainder of the semicircular cavity 58' assumes a smaller diameter, with a flat top that lacks the slot 60.

The parts thus described, the nut 20, the clamping tube 28, the clip 38, the pin holder 44 and plug 56 cooperate to form the male plug assembly 12. These parts are generally located on the outside of the instrument 18. The remaining components are located on or inside the instrument 18 and comprise the instrument socket 16.

Figure 6:
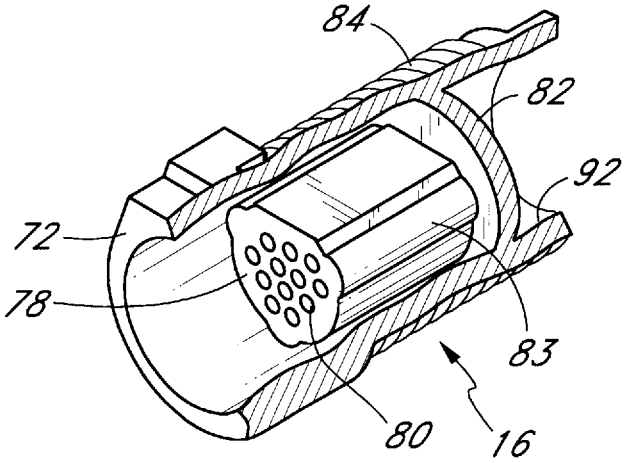
FIG. 6 shows a cut-away perspective view of one component of this invention.
Figure 7:
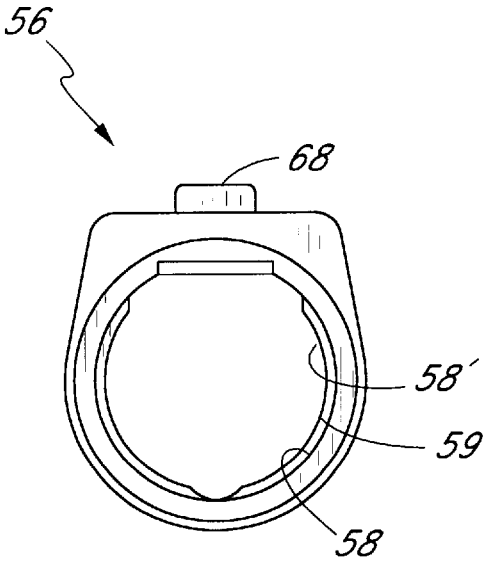
FIG. 7 shows an end view taken along 7—7 in FIG. 2.

Referring to FIGS. 2, 3 and 6, the socket 16 comprises a tubular piece of plastic, with a radial flange 72 on its distal end. The flange 72 contains a catch 74 configured to releasably engage the latch 68. The interior of the proximal end of socket 16 is a cylindrical cavity 76 that extends toward the distal end of the socket. Inside the cavity 76 is a socket holder 78 that contains a plurality of tubular apertures 80. The socket holder 78 extends from a wall 82 located toward the proximal end of the socket 16. The socket holder 78 contains three ribs 83 substantially equally spaced about its periphery. Preferably the socket holder 78, wall 82, and ribs 83 are integraly molded to form a single piece. The size and location of ribs 83 advantageously correspond to those of ribs 50 on pin holder 44. The socket holder 78 is spaced apart from the cavity 76 by a distance corresponding to the thickness of the wall forming proximal end 64 of the plug 56. Indeed, the proximal cavity 58' at the proximal end 64 of plug 56 is sized and configured to snugly and slidably engage the ribs 83 on the socket holder 78. The proximal cavity 58' thus allows the slidable insertion of ribs 50, 83 and the accompanying portions of pin and socket holders 44, 78, respectively. The cavity 58' is configured to allow insertion of pin and socket holders 44, 78 respectively, in only one orientation, so that the tubes 52, 80 in the pin and socket holders 44, 78, respectively, align.

Referring to FIGS. 1, 2 and 3, the proximal end of the socket 16 contains external threads 84 that are sized and configured to extend through a corresponding aperture 86 (FIG. 1) in one wall 88 on the instrument 18. A threaded nut 90 is sized and configured to threadably engage the external threads 84 to clamp the wall 88 between the flange 72 and nut 90 so as to hold the socket 16 to the instrument 18.

Referring to FIGS. 2, 3 and 6, the proximal end of socket 16 has a cavity 92 having a semicircular shape with a flat top. An electrically conductive tube 94 is sized and configured to snugly and slidably fit within cavity 92. The tube 94 is preferably made of thin, spring brass or other conductive metal and bent to conform to the cavity 92. A wire **43*i* electrically connects the tube 94 to socket 45*i*. Preferably, socket 45*i* in cable 10*i* is at ground potential. Wire 43*i* electrically connects tube 94 to socket 45*i* which is at ground potential through connection sheath 19*i* that is at ground potential. Preferably the wire 43*i* is soldered to tubular socket 45*i*. Sheath 19*i* is also electrically connected to the common ground through tubular socket 45*i*. Advantageously, a wire 47*i* electrically connects the conductive sheath 19*i* to the tubular socket 45*i*. Preferably, the wire 47*i* is soldered. Preferably, at least a portion of the conductive sheath 19*i* is twisted into a conductive, wire-like connector and soldered directly to pin 45*i***. Other configurations for electrically communicating the various electrical parts to ground may be devised by one skilled in the art given the present disclosure.

Tube 94 contains means to prevent it from being urged into electrical contact against the pins **96*i* or the exposed portions of wires from cable 10*i* that connect to those pins. Preferably, a portion of the tube 94 physically contacts a portion of the socket 16 to limit the position of the tube 94 relative to the socket 16, with the resulting position of the tube 94 being sufficient to shield the electrical connection of the wires in cable 10*i*, but also sufficient so that the tube 94 does not electrically contact any portions of that electrical connection. Preferably the tube 94 has an elongated member 98 extending axially from the distal end of tube 94. This member 98 abuts a portion of wall 82 (FIG. 6) in socket 16 to limit the axial position of tube 94 relative to socket 16. The tube 94 is orientated so that the abutment occurs where no tubular sockets 80 are located or in use, and at a distance sufficiently far from the electrical connection to those sockets 80** to ensure there is no electrical contact.

A portion of the member 98 could be coated with an insulating material for further protection against undesirable electrical contact. A radial projection off of tube 94 could also be used, with the radial projection engaging the proximal end of socket 16 to correctly position tube 94. This can be achieved by bending a portion of the tube radially outward, or by otherwise enlarging a portion of the tube 94 radially. For example, motion could be limited by placing a bead of solder on the exterior surface of the tube 94 at a location that would contact the proximal end of socket 16 in order to limit the amount which tube 94 can be inserted into the socket. Other constructions and configurations for limiting the motion of tube 94 or analogous parts can be devised by one skilled in the art given the present disclosure.

Assembly

In use, the connector 14 is comprised of two parts, the plug assembly 12 and socket assembly 16. The plug assembly 12 is formed from assembling several parts, comprising nut 20, clamping tube 28, clip 38, pin holder 44 and plug 56. The plug assembly 12 forms the terminal end of the cable 10 from the sensor. The socket 16 is connected to the instrument 18. The shield socket 16 may also be assembled from several parts, comprising a fastener such as nut 90 and shielding tube 94. The plug assembly 12 can be removably inserted into socket 16 to transmit the electronic signals from sensor cable 10 to the instrument cable **10*i* internal to the instrument 18**.

Referring to FIGS. 2 and 3, the proximal end of the sensor cable 10 has a plurality of wires that are connected to prongs or pins 96, preferably with each of the internal wires in cable 10 terminating in its own pin. One of the wires in sensor cable 10 is a ground wire that runs the length of cable 10 and terminates in pin 45, which is one of the pins 96. The pins 96, including pin 45 which is at ground potential, thus extend through aperture 22 in nut 20, through the clamping tube 28 and the clip 38, with the pins 96 being inserted into and through tubes 52 in pin holder 44. The internal threads in nut 20 are screwed onto the external threads 62 to axially compress the clamping tube 28, clip 38 and pin holder 44 between the nut 20 and plug 56, and to hod those parts together. The axial compression by tightening nut 20 causes tapered portion 24 of nut 20 to radially compresses the splines 30 causing them to clamp against the cable 10 to hold it tight and restrict movement of the cable 10 relative to plug assembly 12.

The clip 38 fits inside clamping tube 28, with the tab 42 abutting the edge of flat portion 34 to restrict axial movement of the tab 42. The tab 42 slides into slot 60 and is shaped to form a spring that is resiliently urged against the conductive coating on the inside of the slot 60 to make an electrical contact with that coating. The flange 48 of pin holder 44 abuts the ledge 59 to limit the axial movement of pin holder 44 inside the cavity 58, 58'. The flange 48 of pin holder 44 also abuts the end of tube 28 to limit the axial motion of clamping tube 28 so that the tube 28 can fit within the distal end of cavity 58. The metal tab 42 extends over a portion of the distal end of latch 68 to shield a portion of the hole surrounding that latch 68.

As the wire 43 is electrically connected to the clip 38 and pin 45 at ground potential, the interior of the cavity 58, 58' and the slot 60 are also electrically connected to clip 38, wire 43, and ground 45. Clip 38 thus advantageously comprises an electrically conductive member that is located intermediate the conductive walls of cavity 58, 58' and the parts contained in that cavity 58, 58'. As the clip 38 is urged against the conductive layer on cavity 58, 58', the Clip 38 facilitates electrical communication between the conductive layer on cavity 58, 58' and the pin 45 at ground potential. Other constructions and configurations of such intermediate conductive members and electrical connections can be devised by one skilled in the art given the present disclosure.

The shape of the nesting parts such as ribs 50, flat portions 34, 46, tab 42, slot 60 and cavities 58, 58' all cooperate to ensure that the parts fit together in only one orientation. Further, when assembled, the shielded sensor cable 10 terminates inside, and is surrounded by, the electrically grounded cavity 58, 58'. Moreover, the pins 96 and pin holder 44 are also located inside, and surrounded by, but not in electrical communication with, the electrically grounded cavity 58, 58' that extends the length of plug 56. There is thus advantageously provided a grounded, electromagnetically shielded, covering for the end connection of the cable 10.

The instrument 18 has an internal cable 10*i* that terminates in tubular sockets 96*i*, and that has a ground wire 45*i* running the length of cable 10*i*. The cable 10*i* transmits the electronic signals from the patient sensor to the appropriate locations in the instrument 18. The tubular sockets 96*i* are inserted through metal tube 94, through nut 90 and the proximal end 84 of socket 16, and into the tubes 80 of socket holder 78. When proximal end 64 of plug 56 is slidably inserted into the cavity 76 of socket 16, the pins 96 and corresponding sockets 96*i* make electrical contact. The shape of the mating parts such as ribs 83, cavity 58, 58' and latch 68 all cooperate to ensure that the parts fit together in only one orientation. As shown in FIG. 3, the pins 96 and mating sockets 96*i* are within and surrounded by electrically grounded cavity 58, 58'. Further, the metal tube 94 also extends into cavity 58, 58' to surround the terminating end of cable 10*i* from the instrument 18. The cavity 58, 58' thus slightly overlaps the tube 94. There is thus provided a means for substantially surrounding, and shielding from electromagnetic interference, the connection from the cable 10 to the instrument 18.

Further, this arrangement provides two commonly grounded segments of the connector 14, grounded through a common wire electrically connected to one of the pins 96, preferably pin 45 and socket 45*i*. Sheath 19 is grounded to pin 45 by wire 47. Similarly, the external plug portion of the connector 14 is grounded to pin 45. Specifically, clip 38 and plug 56 are grounded to the pin 45 by wire 43, but that portion of the connector is insulated from the instrument 18. Likewise the socket portion of connector 14 is grounded to the common ground pin 45. Sheath 19*i* is grounded to tubular socket 45*i* by wire 47*i*. While tube 96 is electrically connected to ground socket 45*i* by wire 43*i*, that portion of the connector is insulated from the distal portion of connector 14 by the plastic socket 16. But the ground pin 45 electrically communicates with ground socket 45*i* when the plug 56 is inserted into the socket 16. Thus, the metal tube 94, conductive coating on cavity 58, 58' and clip 38 are electrically connected to pin 45 and mating socket 45*i* which are at both at ground potential.

There is thus advantageously provided a means for shielding a connector 14 from EMI that distorts the signal from the patient sensor. This shielding is not only in the portion of the connector 14 external to the medical instrument 18, but also in the socket portion 16 of the connector internal to the instrument. Even though the connector 14 is small in length, the signal distortion from having the connector unshielded is significant. The use of the conductive clip 38, the tube 94 and the conductive coating in cavity 58, 58' advantageously provide an appropriately grounded and shielded cavity to substantially surround the connection between shielded cable 10 from the patient sensor and cable 10*i* from the instrument 18. This grounded and shielded cavity provides significantly improved signal transfer with significantly reduced signal distortion from EMI. There is some slight portion of the connector that is not shielded, as the slight gap between lever 68 and the plug 56 is not shielded. But this gap is only about 0.020 inches (6.5 mm), and limited in length. Other arrangements for shielding a connector with these specific connector components and for grounding the conductive portions of those components can be devised by one skilled in the art given the present disclosure.

Further, there are many instruments with connectors similar to the connector 14 in construction, but that are made out of plastic without any of the shielding or grounding described above. The addition of the clip 38, conductive cavity 58, 58' and tube 94, with the appropriate grounding connections 43, 43*i*, 47, 47*i* provide a cost effective way to shield these pre-existing connectors 14. Indeed, the modification to the instrument 18 is minimal as only the tube 94 need be inserted and grounded. As many medical instruments have no such shielding immediately adjacent the electrical connection with the socket 16, the possibility of EMI from the instrument 18 distorting the signals transmitted through the socket 16 is significant. This addition to the socket portion 16 of connector 14 is thus believed to provide substantial improvement in reducing EMI distortion by itself. But preferably the shielding of socket 16 is used with the external portion of connector 14, also shielded as described above.

There is thus advantageously provided means for shielding existing connectors by providing appropriate conductive connections such as clip 38 and appropriate shielded cavities such as cavity 58, 58' on the plug side of the connector 14, while providing EMI shields such as shield 94 on the instrument side of the connector 14. When assembled, the shielded portions of the two parts of connector 14 overlap to provide substantially complete shielding of the connection between plug 12 and socket 16. Other arrangements for shielding a connector with these specific connector components and for grounding the conductive portions of those components can be devised by one skilled in the art given the present disclosure.

Alternate Embodiment

Figure 4:
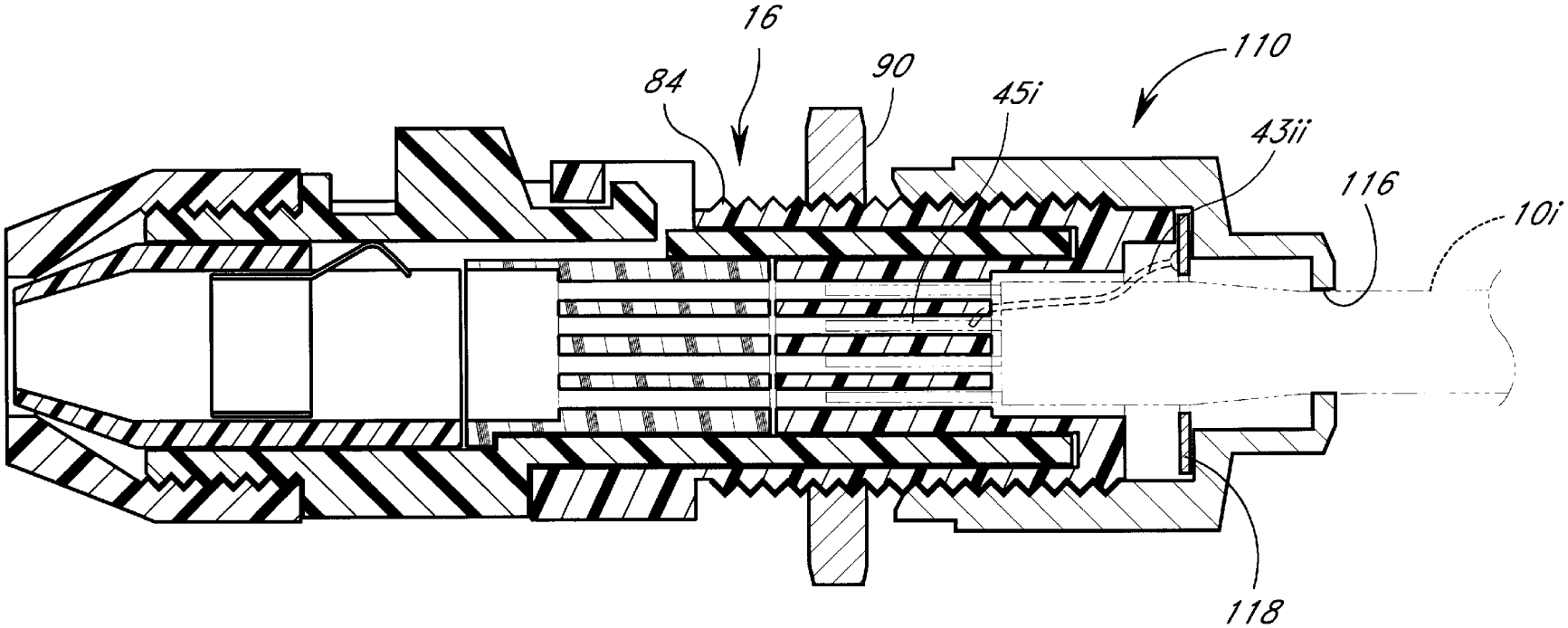
FIG. 4 shows a cross-sectional view of an alternate embodiment of this invention.
Figure 5:
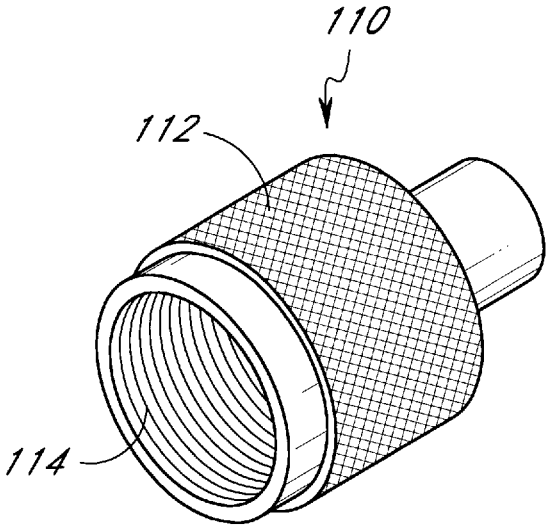
FIG. 5 shows a perspective view of one component of this invention.

FIGS. 4 and 5 illustrate an alternate embodiment that uses a different connector in the instrument 18 to shield the socket 16. The parts with like construction. Are given the same number and the description of those parts will not be repeated. The socket 16 is clamped to the wall 88 of instrument 18 by nut 90 threaded on external threads 84 of socket 16. An electrically conductive nut 110 is sized and configured to also screw onto the proximal end of threads 84 of socket 16. The nut 110 is preferably made of brass, and has a distal cylindrical portion 112 with an internally threaded cavity 114 sized and configured to engage threads 84 on socket 16. The external surface of portion 112 has a textured surface to facilitate tightening by hand. A knurled surface is suitable. The proximal end of nut 110 has a reduced diameter with aperture 116 of sufficient size to allow cable 10*i*, which includes ground wire 45*i*, to snugly pass through.

An electrically conductive washer 118, preferably made of brass, is placed over the cable 10*i* and a wire 43*ii* electrically connects the washer 118 to the pin 45*i* at ground potential. Preferably the wire 43*ii* is soldered. The nut 110 is hand tightened onto the proximal end of socket 16, to contact the washer 118 and make eT electrical connection grounding the nut 110. The nut 110 thus provides a shielded cavity encasing the electrical connection of the cabs 10*i*, with the socket 16. The EMI shielding provided by nut 110 overlaps with the shielding provided by shielded cavity 58, 58' in plug 56. But the nut 110 is electrically isolated from cavity 58, 58', and is electrically connected to a common ground via a ground wire in electrical communication with pins 45, 45*i*, clip 38, and the conductive coating on cavity 58, 58'.

It will be understood that the above-described arrangements of apparatus and the method of shielding and grounding the various parts are merely illustrative of applications of the principles of this invention and many other embodiments and modifications may be made without departing from the spirit and scope of the invention as defined in the claims.

We claim:

1. An electrical connector for transmitting signals from a sensor to a medical instrument through a plug connected to one end of an external shielded cable, and through a socket on the instrument that is connected to an internal shielded cable inside the instrument, comprising:

a non-conductive, elongated nut having a distal end with a tapered interior surface, the distal end having an aperture therethrough sized to receive the cable from the sensor, and having an engaging surface on the proximal end of the nut;

a non-conductive, generally tubular plug having an internal cavity extending the length of the plug with the cavity having two different diameters, the distal end of the plug having an engaging surface adapted to engage the engaging surface on the proximal end of the nut to hold the nut and plug together, the proximal end of the plug configured to engage a socket, the cavity having an electrically conductive surface on it;

a cylindrical clamping tube with its distal end adapted to fit within and cooperate with the tapered end of the nut to clamp against a cable inserted through the aperture in the nut and inserted through the clamping tube;

a conductive member fitting between the clamping tube and the conductive surface when the clamping tube is inserted into the plug's cavity; and a pin holder having a plurality of apertures adapted to hold a plurality of pins from a terminal end of the cable, the pin holder being configured to snugly fit within the interior cavities of the tubular plug, the pin holder insulating the apertures from the conductive coating on the plug, and having a distal end abutting a proximal end of the clamping tube when the nut is placed onto the distal end of the plug.

2. An electrical connector as defined in claim 1, wherein the conductive member further comprises a conductive member encircling a portion of the clamping tube and having a portion urged radially outward to engage the conductive surface on the plug when the conductive member and clamping tube are placed inside the plug and retained there by the nut.

3. An electrical connector as defined in claim 1, further comprising a cable inserted through the aperture in the nut and held by the clamping tube, the cable terminating in a plurality of wires that are connected to pins that are placed in the apertures in the pin holder, with one of the pins being at ground potential and also being in electrical communication with the conductive surface through the conductive member and with the shielding on the cable from the sensor.

4. An electrical connector as defined in claim 3, further comprising:

a non-conductive socket adapted for mounting to an instrument, the socket comprising a non-conductive housing with a distal end configured to engage the proximal end of the plug, the socket having a proximal end internal to the instrument;

a socket holder connected to the socket and having a plurality of apertures adapted to electrically engage the pins from the cable, the socket holder electrically insulating its apertures from the instrument and socket, the socket holder configured to snugly fit within the proximal end of the cavity in the plug so that at least a portion of the socket is surrounded by the electrically conductive surface;

an electrically conductive shield connected to the proximal end of the socket, the shield being of sufficient size and length to surround an electrical connection between the apertures in the socket and a plurality of wires emanating from a shielded cable internal to the instrument, the plug and socket cooperating so that the electrically conductive surface on the plug cavity overlaps with a portion of the shield.

5. An electrical connector as defined in claim 4, further comprising a cable from the instrument inserted through the shield, the cable terminating in a plurality of wires that are electrically connected to the apertures in the socket holder, at least one of the wires from the instrument being at ground potential and located to electrically engage the pin at ground potential when the plug is inserted into the socket, the shield being in electrical communication with that same potential at ground, the shield further being placed in electrical communication with an EMI sheath on the shielded cable inside the instrument.

6. A medical instrument having a housing that provides EMI shielding to electronic devices within the housing, the housing having a socket that is not shielded against EMI, where the socket is mounted to and extends through the instrument housing, the socket being adapted for receiving a plug to transmit signals electrically from the plug through the socket to the electronic devices in the instrument, the socket having a plurality of internal wires emanating from an internal instrument cable having shielding for electromagnetic interference, the internal wires connecting to the socket to receive and transmit the signals to the electronic devices in the instrument, the connection between the shielded instrument cable and the socket having no EMI shielding adjacent to and surrounding the electrical connection with the socket, comprising:

adding an electrically conductive material connected to the socket internal to the instrument and configured to surround and shield from EMI the electrical connection of the wires to the socket, and further configured to surround and shield from EMI at least a portion of the shielded instrument cable; and an electrical connection placing the conductive material in electrical communication with a wire inside the plug at ground potential, and placing the conductive material in electrical communication with the EMI shielding on the instrument cable.

7. A medical instrument as defined in claim 6, wherein the electrical connection between the conductive material and ground comprises electrically connecting the wire at ground potential to a tubular socket in the instrument socket.

8. A medical instrument as defined in claim 7, wherein the conductive material comprises a tube having an electrically conductive surface and having a distal end configured to fit within a proximal end of the socket, the tube not coming into electrical communication with any of the wires connected to the socket that transmit electronic signals but being in electrical communication with the wire at ground potential.

9. A medical instrument as defined in claim 7, further comprising:

a plug in electrical communication with the socket to transmit electrical signals to the instrument, the plug having a plurality of wires external to the instrument emanating from an external cable having shielding for EMI, the external wires connecting to pins that are in electrical communication with corresponding portions of the socket to transmit signals electrically to the instrument through the socket;

an electrical connection placing the shielding on the external cable in electrical communication with a pin on the plug that is at ground potential and that is further in electrical communication with a portion of the socket in the instrument that is also at ground potential through the wire in the instrument that is at ground potential;

an electrically conductive material on the plug that is located to: (a) substantially surround the electrical connection between the external wires and the pins; (b) substantially surround the electrical connection between the pins and the socket; and (c) substantially surround a portion of the conductive material in the instrument to provide an overlap in EMI shielding; and electrical connections placing the conductive material on the plug in electrical communication with the pin on the plug that is at ground potential and with the EMI shielding on the external cable.

10. A medical instrument having a housing that provides EMI shielding from external sources to electronic devices within the housing, the housing having a non-EMI shielded socket mounted to and extending through the instrument housing, the socket being adapted for receiving a plug to transmit signals electrically from the plug through the socket to the electronic devices in the instrument, the socket having a plurality of internal wires emanating from an internal instrument cable having shielding for electromagnetic interference, the internal wires connecting to the socket to receive and transmit the signals to the electronic devices in the instrument, the connection between the shielded instrument cable and the socket having no EMI shielding adjacent to and surrounding the electrical connection with the socket, comprising:

EMI shielding means added to the socket for substantially surrounding the electrical connection of the wires to the socket and for substantially surrounding a portion of the shielded cable; and means for electrically communicating between the socket shielding means and a tubular socket in the instrument socket that is at ground potential and for electrically communicating between that tubular socket and the EMI shielding on the instrument cable.

11. A medical instrument as defined in claim 10, further comprising:

a plug in electrical communication with the socket to transmit electrical signals to the medical instrument, the plug having a plurality of wires external to the instrument emanating from an external cable having shielding for EMI, the external wires connecting to pins that are in electrical communication with corresponding portions of the socket to transmit signals electrically to the instrument through the socket;

EMI shielding means on the plug for shielding the electrical connection between the external wires and the pins from EMI and for shielding the electrical connection between the pins and the socket from EMI, the plug shielding means cooperating with the socket shielding means to provide some overlap in the shielding provided by the plug shielding means and the socket shielding means, the plug shielding means being electrically connected to the EMI shielding on the external cable and being in further electrical communication with a pin on the plug that is at ground potential through the tubular socket that is at ground potential.

12. A connection with a medical instrument having a housing that provides EMI shielding from external sources to electronic devices within the housing, the housing having a non-EMI shielded socket mounted to and extending through the instrument housing, the socket being adapted for receiving a plug to transmit signals electrically from the plug through the socket to the electronic devices in the instrument, the socket having a plurality of internal wires emanating from an internal instrument cable having shielding for electromagnetic interference, the internal wires connecting to the socket to receive and transmit the signals to the electronic devices in the instrument, the connection between the shielded instrument cable and the socket having no EMI shielding adjacent to and surrounding the electrical connection with the socket, comprising:

sufficient EMI shielding added to the socket to substantially surround the electrical connection of the wires to the socket and to substantially surround a portion of the shielded cable; and an electrical connection between the socket shielding and a tubular socket in the instrument socket that is at ground potential and for electrically communicating between that tubular socket and the EMI shielding on the instrument cable.

13. A medical instrument as defined in claim 12, further comprising:

a plug in electrical communication with the socket to transmit electrical signals to the medical instrument, the plug having a plurality of wires external to the instrument emanating from an external cable having shielding for EMI, the external wires connecting to pins that are in electrical communication with corresponding portions of the socket to transmit signals electrically to the instrumnent through the socket;

EMI shielding on the plug for shielding the electrical connection between the external wires and the pins from EMI and for shielding the electrical connection between the pins and the socket from EMI, the plug shielding cooperating with the socket shielding to provide some overlap in the shielding provided by the plug shielding and the socket shielding, the plug shielding being electrically connected to the EMI shielding on the external cable and being in further electrical communication with a pin on the plug that is at ground potential through the tubular socket that is at ground potential.

14. A process for shielding a connector for a medical instrument, the connector having a non-conductive plug with a cavity that surrounds a pin holder and the electrical connection between a sensor cable and the pin holder, the plug cavity being further adapted to receive a portion of a socket holder inside the plug so that shielded sensor wires connected to the pin holder and shielded instrument wires connected to the socket holder can make electrical contact when the pins engage the socket holder inside the cavity of the plug, the socket holder being connected to a socket mounted to an instrument, comprising the steps of:

placing an electrically conductive material intermediate the plug cavity and the parts placed within that cavity that are adjacent to that cavity;

inserting a tube of electrically conductive material into a proximal end of the socket to surround an electrical connection between the socket holder and wires from the instrument, and surrounding a portion of that tube with the conductive material in the cavity; and placing that conductive material in electrical communication with a pin extending into the pin holder that is at a ground potential;

placing that conductive material in electrical communication with the shielding from the sensor wire;

placing the tube in electrical communication with that same pin at ground potential; and placing the shielding from the instrument wire in electrical communication with the same pin at ground potential.

15. A process as defined in claim 14, wherein the step of placing an electrically conductive material intermediate the plug cavity and the parts placed within that cavity comprises the step of coating the cavity walls with a conductive material.

16. A process as defined in claim 14, wherein the step of placing the conductive material in electrical communication with a pin comprises the step of soldering a wire to the pin at ground potential and placing that wire in electrical communication with an electrically conductive member that is resiliently urged against the conductive material in the cavity.

17. A process as defined in claim 14, wherein the step of placing the tube in electrical communication with that same ground potential comprises the step of soldering a wire to the tube and placing that wire in electrical communication with the pin at ground potential.

18. A process for shielding a pre-existing connector configuration, the connector having a non-conductive plug with a cavity therein, the cavity containing a removable pin holder and the electrical connection between a shielded sensor cable and the pin holder, the plug cavity being further adapted to receive a portion of a socket holder inside the plug so that a shielded instrument cable with wires connected to a socket holder can make electrical contact when the pins engage the socket holder inside the cavity of the plug, the socket holder being adapted to connect to a socket mounted to an instrument, comprising the steps of:

coating the cavity of the pre-existing plug configuration with an electrically conductive material;

placing that conductive material in electrical communication with a pin extending into the pin holder that is at a ground potential;

connecting a shielded cable containing a plurality of wires to the plug by connecting the wires to pins in the plug, and placing the shield of the cable in electrical communication with the pin at ground potential.

19. A process as defined in claim 18, comprising the further step of inserting a cable into the plug and connecting a plurality of wires in the cable with pins in the plug; placing that pin that is at ground potential in electrical communication with that conductive material in electrical communication with a pin extending into the pin holder that is at a ground potential;

inserting a tube of electrically conductive material into a proximal end of the socket to surround an electrical connection between the socket holder and wires from the instrument, and overlapping the conductive material with a portion of that tube; and placing that conductive material in electrical communication with the shielding from the sensor cable;

placing the tube in electrical communication with that same ground potential; and placing that tube in electrical communication with the shielding from the instrument wire.

20. A process as defined in claim 18, wherein the step of placing an electrically conductive material intermediate the plug cavity and the parts placed within that cavity comprises the step of coating the cavity walls with a conductive material.

21. A process as defined in claim 18, wherein the step of placing the conductive material in electrical communication with a pin comprises the step of soldering a wire to the pin at ground potential and placing that wire in electrical communication with an electrically conductive member that is resiliently urged against the conductive material.

22. A process as defined in claim 18, wherein the step of placing the tube in electrical communication with that same ground potential comprises the step of soldering a wire to the tube and placing that wire in electrical communication with the pin at ground potential.

23. A medical instrument connection between an instrument having a housing that provides EMI shielding from external sources to electronic devices within the housing, the housing having a non-EMI shielded socket mounted to and extending through the instrument housing, the socket being adapted for receiving a plug to transmit signals electrically from the plug through the socket to the electronic devices in the instrument, the socket having a plurality of internal wires emanating from an internal instrument cable having shielding for electromagnetic interference, the internal wires connecting to the socket to receive and transmit the signals to the electronic devices in the instrument, the connection between the shielded instrument cable and the socket having no EMI shielding adjacent to and surrounding the electrical connection with the socket, comprising:

an EMI shielded socket having EMI shielding internal to the housing and connected to the socket to substantially surround the electrical connection of the internal wires to the socket, the EMI shielding also substantially surrounding at least a portion of the shielded cable;

a plug in electrical communication with a sensor through an external cable that is shielded against EMI, the plug having a plurality of pins, one of which is at ground potential, the plug having electrically conductive surfaces substantially surrounding the electrical connection between the external shielded cable and the pins to shield the connection from EMI, the EMI shielding on the plug and socket cooperating to substantially surround the connection between the plug and socket with a conductive surface in electrical communication with the pin at ground potential and form an EMI shield.

* * * * *